US005151050A

United States Patent [19]

Scholz et al.

[11] Patent Number: 5,151,050

[45] Date of Patent: Sep. 29, 1992

[54] CABLE ASSEMBLY

[75] Inventors: James P. Scholz, Mechanicsburg; Daniel E. Stahl, Dauphin, both of Pa.

[73] Assignee: AMP Incorporated, Harrisburg, Pa.

[21] Appl. No.: 768,125

[22] Filed: Sep. 30, 1991

[51] Int. Cl.[5] ..... H01R 13/58

[52] U.S. Cl. ..... 439/456

[58] Field of Search ..... 439/456, 459

[56] References Cited

U.S. PATENT DOCUMENTS

| | | | |
|---|---|---|---|
| 3,781,766 | 12/1973 | Teagno et al. | 439/297 |
| 3,854,787 | 12/1974 | Snyder, Jr. | 439/469 |
| 4,367,005 | 1/1983 | Douty et al. | 439/357 |
| 4,629,276 | 12/1986 | Genaro et al. | 439/459 |
| 4,761,145 | 8/1988 | Goto et al. | 439/469 |

FOREIGN PATENT DOCUMENTS

| | | | |
|---|---|---|---|
| 235843 | 5/1945 | Switzerland | 439/456 |

*Primary Examiner*—Gary F. Paumen
*Attorney, Agent, or Firm*—Katherine A. Nelson

[57] ABSTRACT

A cable assembly 40 having integral strain relief means includes a housing 42 having a plurality of terminal members 28 secured in a cable terminating cavity 60 therein, an electrical cable 30 having a plurality of discrete conductors 36 therein terminated to respective terminal members 28 and potting material 23 disposed in the cavity 60. The inner surface of a sidewall 59 of the housing 42 extends at an oblique angle between front 48 and rear walls 54 thereof. The front wall 48 has an inwardly directed peninsula shaped protrusion 52 extending into the cable terminating cavity 60, the protrusion 52 and the obliquely extending sidewall 59 defining a cable receiving channel 62 therebetween. The electrical cable 30 including an insulating cover portion 32 is inserted into a cable receiving opening 64 in the front housing wall 48 and along the cable receiving channel 62 and about the protrusion 52. The elongated cable receiving channel 62 provides a strain relief for the terminated cable 30 and means to direct a desired exit path for the cable 30.

2 Claims, 5 Drawing Sheets

CABLE ASSEMBLY

FIELD OF THE INVENTION

The present invention is directed to electrical connectors and more particularly to electrical connectors used in making cable assemblies.

BACKGROUND OF THE INVENTION

There is wide spread use of cable assemblies in the electronics industry. An assembly includes an insulated wire cable having a connector terminated at both ends. The cable includes insulation surrounding a plurality of individual insulated wires and in many instances also includes a ground braid. One way of terminating the wires within the cable is achieved by soldering exposed sections of the individual wires to the selected terminals. The ground braid is electrically connected to ground by means of a bare wire having one end wrapped around and soldered to the braid and the other end soldered to ground. The terminated cable exits a connector housing along one of the sides thereof. When using the cable assembly, it is often necessary to route the cable in a direction different from that with which it exits the connector housing. If the change in direction is relatively abrupt, such as bending the cable to run at essentially right angles to the housing side wall, considerable strain is placed on the end of the cable, the electrical connections within the connector and particularly at the place where the cable exits the housing. The strain may cause the outer insulating cover of the cable to pull away from the housing thus exposing the ground braid and or portions of the insulated wires. It is desirable, therefore, to provide some kind of strain relief for the cable as it exits the housing.

One way of providing strain relief for cables includes the use of additional members such as clamps, covers or the like. U.S. Pat. No. 4,367,005, for example discloses cover members used for strain relief. U.S. Pat. No. 3,854,787 discloses a strain relief that is integral with the connector housing and extends outwardly from one opposite sides thereof and along a length of cable to prevent bending of the conductors with respect to the housing. The use of additional members or outwardly extending members increases the bulk of the terminated cable assembly and increases the costs of manufacturing and assembly.

Another way to provide strain relief is by the use of a potting material or the like to surround the area of termination and that portion of the cable that extends into a cable terminating cavity. One problem associated with potting material is that it may not adhere well to the insulating cover of the cable, particularly if the cover is made of TEFLON® or similiar materials, which are difficult to adhere to other materials. (TEFLON® is a trademark of E. I. duPont de Nemours and Company.)

To alleviate the above-referenced problems, it is desirable to provide a connector housing having a means for strain relief that readily allows the cable to be bent at a sharp angle.

It is also desirable that the means for providing strain relief be compact and not greatly increase the size of the connector.

It is further desirable that the strain relief be sufficient to minimize stress on the cable and particularly the soldered interconnections, if the cable is pulled or tugged with excessive force from vertical and/or horizonal directions.

It is also desirable to provide strain relief for a cable assembly that is cost effective to manufacture and assemble.

SUMMARY OF THE INVENTION

The present invention is directed to a cable assembly having a built in strain relief that alleviates the difficulties and problems of the prior art. The connector housing includes an internal channeled area that extends along the side of the housing to support a selected length of cable and direct the exit of the cable toward its desired direction. The cable assembly includes a housing having a base having opposed front and rear walls and opposed first and second side walls extending upwardly from a base, the inner surfaces of the walls together defining a cable terminating cavity. The inner surface of at least one of the side walls extends at an oblique angle between the front and rear walls. The front wall of the housing includes a cable receiving opening extending therethrough and in communication with the cable terminating cavity. The front wall further includes an inwardly directed peninsula shaped protrusion extending a selected distance into cable receiving cavity, the protrusion being spaced from the obliquely extending surface with the cable receiving opening positioned therebetween. The protrusion and obliquely extending surface defining a cable receiving channel therebetween. An end of an electrical cable having an insulated cover surrounding a plurality of discrete conductors extends through the cable receiving opening and along the cable channel. Terminal members within the base are soldered to respective conductors within the cavity. A non-conductive potting material is disposed in and filling remaining portions of the cable terminating cavity. The elongated cable receiving channel provides means for relieving strain on said cable when stress is applied thereto and further provides means for directing a desired exit path for the cable.

It is an object of the invention to provide a cable support to relieve stresses on the terminated solder joints during insulation and use of the assembly.

It is a further object of the invention to provide means to direct the exit of the cable from a housing in the same direction as the cable is to be routed to minimize stress on the cable and exposure of the ground braid or wires.

It is also an object to provide a compact means for strain relief that eliminates the need for additional members.

It is yet another object of the invention to provide a means for holding a greater length of the insulating cable cover or jacket within the housing structure.

Some of the objects and advantages of the invention having been stated, others will become apparent from the following description when taken in conjunction with the accompanying drawings of an embodiment of the present invention by way of example.

DETAILED DESCRIPTION OF THE DRAWINGS

Figure 1:
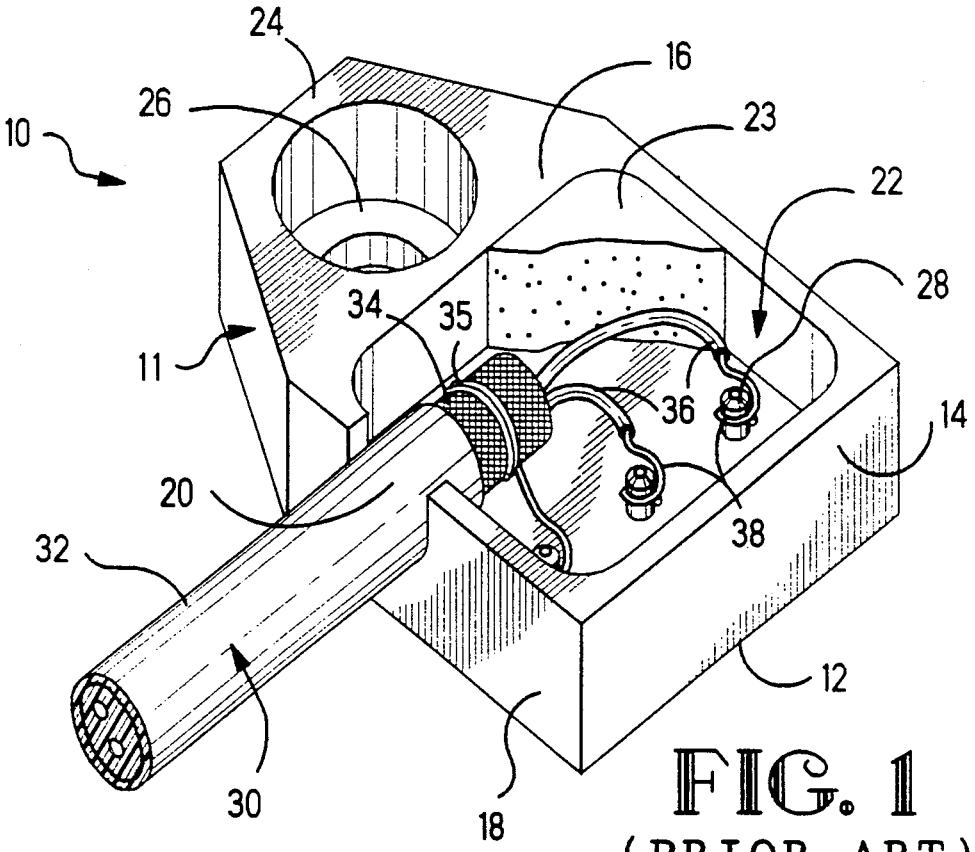
FIG. 1 (PRIOR ART)
FIG. 1 is a perspective view of a terminated cable assembly of the prior art.
Figure 2:
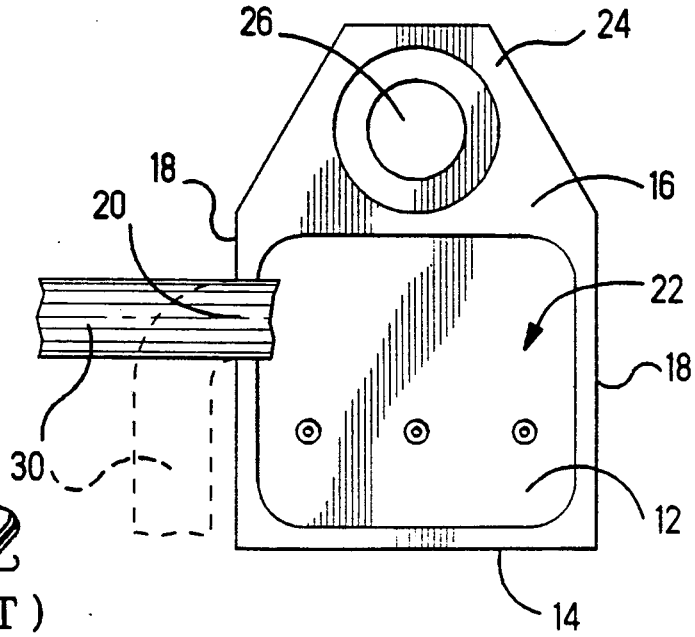
FIG. 2 (PRIOR ART)
FIG. 2 is a top plan view of the prior art connector housing of FIG. 1.

FIGS. 1 and 2 show the prior art cable assembly 10 having a housing 11 and a cable 30. For purposes of illustrating the invention, cable 30 is shown as a shielded cable. Typically this type of cable has an outer insulating cover or jacket of TEFLON ®, a braided conductive shield and a twisted pair of conductors. It is to be understood that the invention is suitable for use with other types of cable as well. Housing 11 includes a base 12, opposed front and rear walls 14,16 and opposed sidewalls 18, which together define a cable terminating cavity 22. One of the sidewalls 18 further includes an opening 20 through which the cable 30 enters the cable terminating cavity 22. The rear wall 16 of assembly 10 further includes a mounting flange 24 having aperture 26 extending therethrough for receiving mounting means therein. A plurality of terminals 28 are secured in base 12. Cable 30 includes an insulating cover 32 surrounding a ground braid 34 and a plurality of individually insulated wires 36 having forward bare-wire end portions 38, which are soldered to the respective terminals 28. The ground braid 34 is electrically connected to a corresponding terminal 28 by means of a wire 35 surrounding the ground braid 34 and soldered thereto. After cable 30 has been terminated within cavity 22, a non-conductive potting material 23, as known in the art, is disposed around the wires and cable. The potting material provides protection for the soldered terminations and eliminates the need for a separate cover member. A portion of the potting material 23 is shown in FIG. 1. As can be seen from FIG. 1, only a short length of the outer insulated cable cover 32 is present within the cable receiving cavity. Potting material 23, therefore, surrounds a corresponding short length of cable. Thus when the cable 30 is bent at an abrupt angle, as shown in phantom in FIG. 2, stress is placed the forward edge of the opening. If a high force is applied to the cable 30, such as by a sudden pulling motion, the cable may be stressed sufficiently to cause the short length of insulation 32 to be pulled away from the potting material and from the cable terminating cavity 22 thereby exposing the ground braid 34 and causing stress on the soldered connections.

Figure 3:
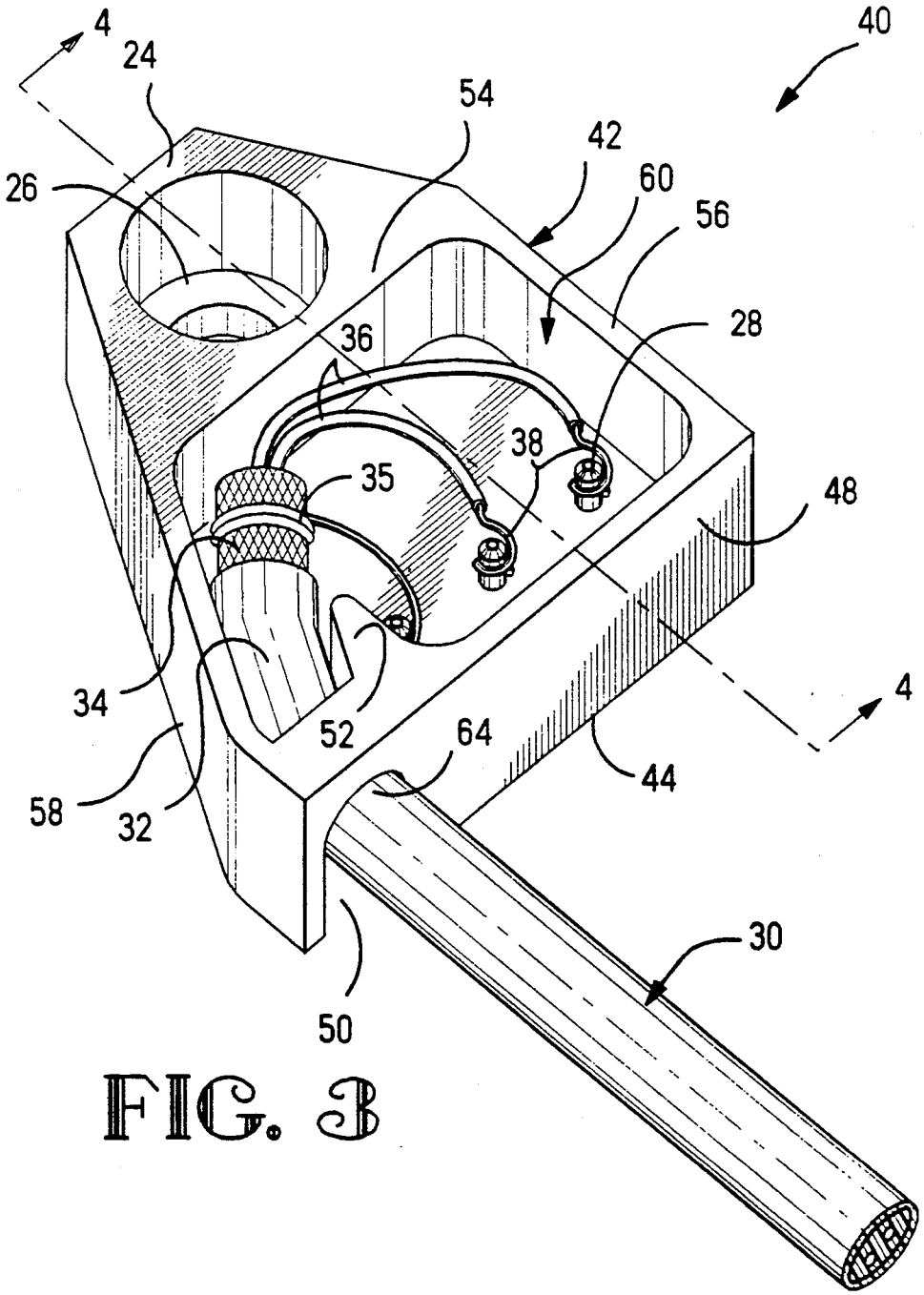
FIG. 3 is a perspective partially exploded view of the terminated cable assembly of the present invention.
Figure 4:
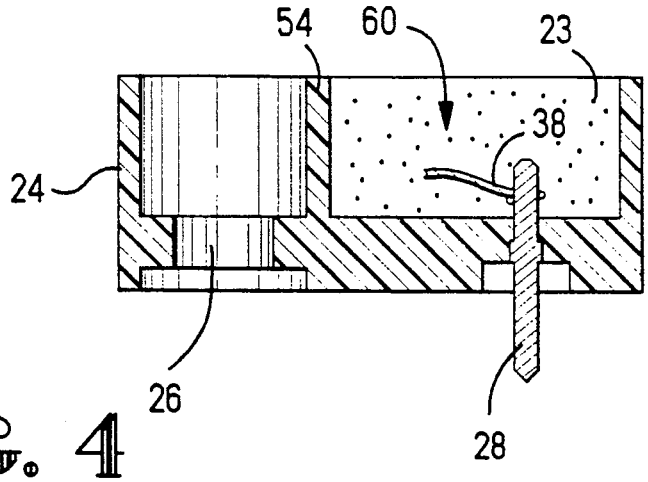
FIG. 4 is a cross-sectional view of the assembled cable assembly.
Figure 5:
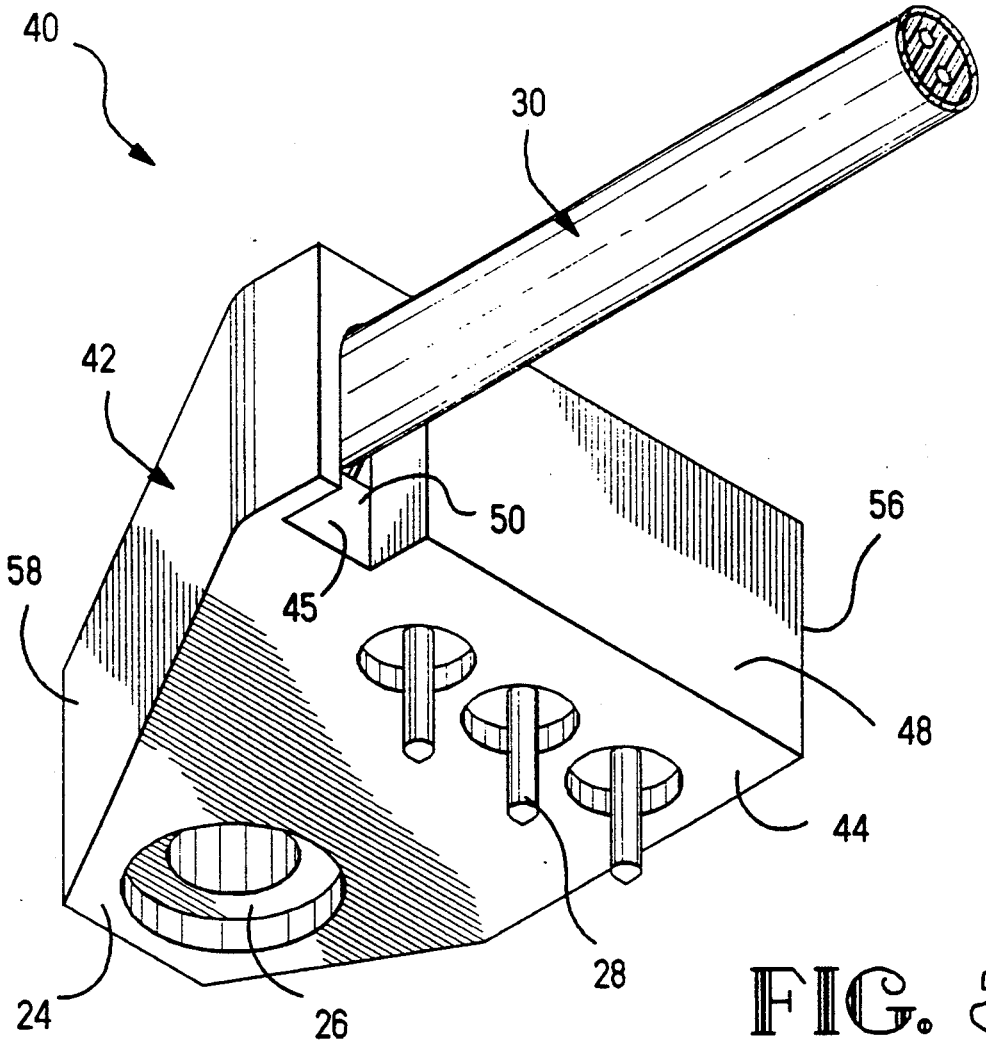
FIG. 5 is a perspective view of the assembly of FIG. 3 looking at the underside thereof.
Figure 6:
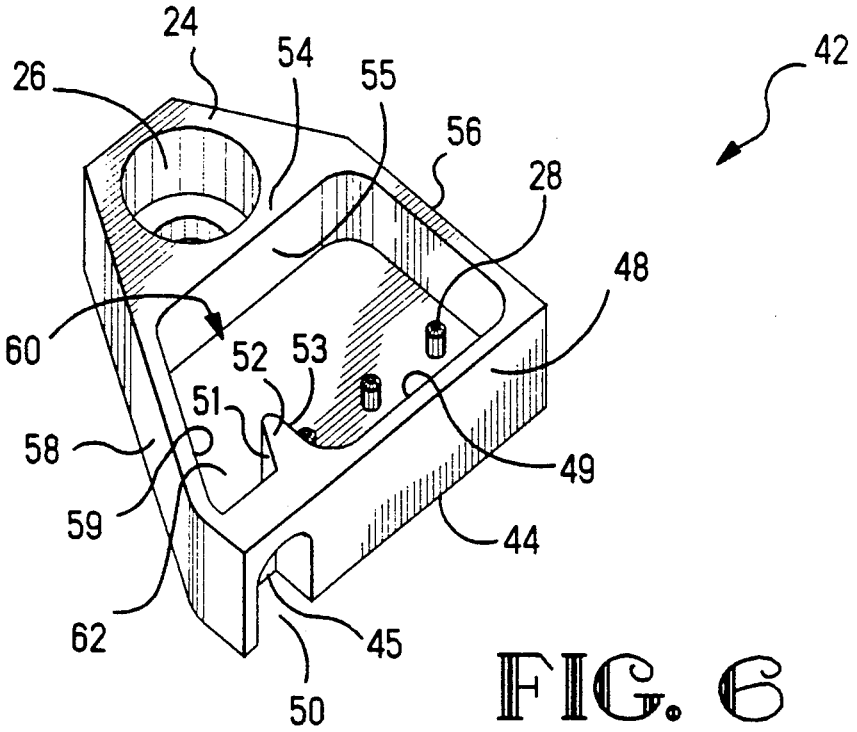
FIG. 6 is a view similar to FIG. 3 with the cable removed.
Figure 7:
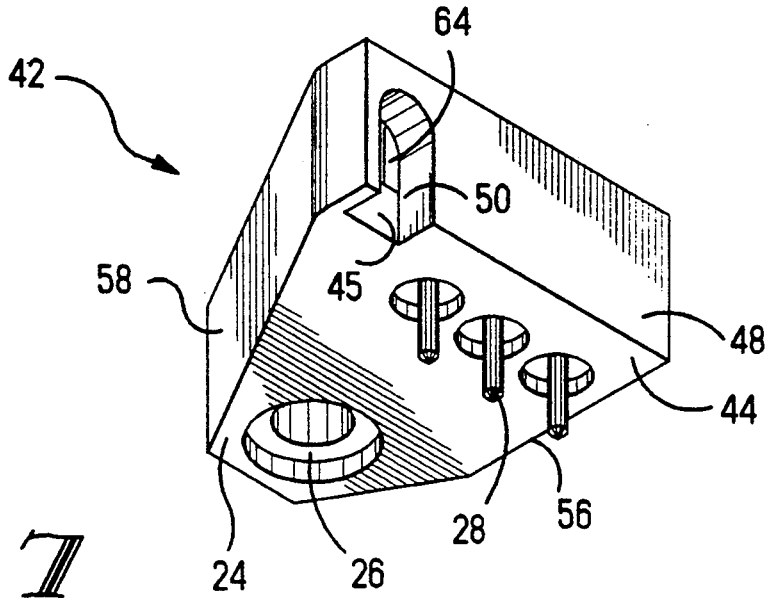
FIG. 7 is a view similar to FIG. 5 with the cable removed.

The above problems are alleviated by the present invention as shown in FIGS. 3, 4 and 5. The cable assembly 40 of the present invention includes a housing 42 having a base 44, opposed front and rear walls 48,54 and opposed first and second side walls 56,58, the inner surfaces of which define a cable receiving cavity 60. A plurality of terminals 28 are secured in base 44. In the preferred embodiment of the invention, housing 42 is insert molded around the desired number of terminals 28. As best seen in FIG. 6, front housing wall 48 includes a slot 50 extending upwardly from base 44 and configured for receiving the cable member 30. In accordance with the preferred embodiment of the invention, a portion of the front wall 48 remains above cable receiving slot 50 to provide a stop surface if vertical forces are applied to the cable 30. Front wall 48 further includes an inwardly directed peninsula shaped protrusion 52 having sides 51 and 53. Slot 50 is located between second sidewall 58 and protrusion 52. Inner surface 59 of second sidewall 58 includes a portion that extends obliquely at a selected angle from inner front wall surface 49 to inner rear wall surface 55. As best seen in FIG. 6, side wall 51 of peninsula protrusion 52 extends into cavity 60 at a similar angle and together with a corresponding portion of second sidewall surface 59 defines a cable receiving channel 62. The opening 64 of the channel 62 is defined by slot 50 and base portion 45 as best seen in FIG. 7 and is dimensioned to snuggly surround and grip cable 30. As can be seen in FIG. 3, channel 62 provides a means for supporting a longer portion of insulated cable 30 than the prior art design shown in FIG. 1. Thus a longer portion of cable 30 is enclosed by potting material 23 thereby reducing the chance that the cable insulation 32 may be pulled out of housing 42 to expose braid 34. Furthermore channel 62 provides a means to gradually bend cable 30 such that it can exit the housing 42 in a desired direction.

Figure 8:
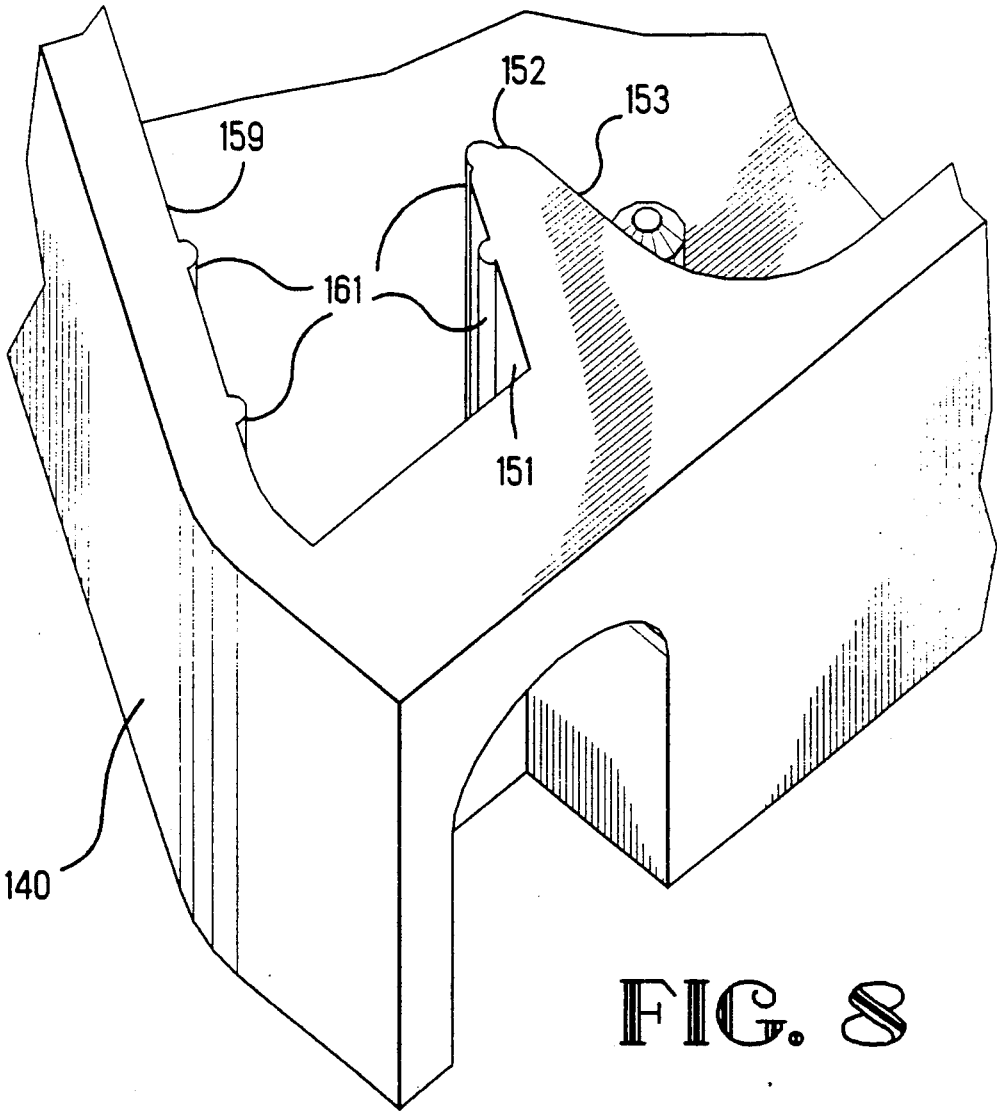
FIG. 8 is an enlarged fragmentary view of a portion of the housing showing and alternative embodiment of the cable receiving channel.

FIG. 8 shows an alternative embodiment 140 of the cable receiving channel in which the inner surface 151 of protrusion 152 and inner wall surface 159 include rib portions 161, which provide additional surfaces to grip cable 30.

FIG. 3 shows ground braid interconnection wire 35 and wires 36 terminated to their respective terminals 28 in the same manner as previously described. After termination is completed, cavity 60 is filled with potting material 23 as is known in the art. For purposes of illustrating the invention, potting material 23 has been omitted in FIG. 3. FIG. 4 shows a cross section of the assembled connector 40 having cavity 60 filled with potting material 23. Preferably the material selected is oue that is compatable to the environmental conditions in which the cable is to be used. A number of materials are known and are commercially available. One such material is an epoxy based material available from Cumin Corporation, South Easton, Mass., under the trade name C-RAM KRS 124.

As shown in this representative example, cable 30 is directed to exit the left front of the housing 42. It is to be understood that the angular orientation of the channel 62 may be modified to direct the cable 30 in a different direction.

The improved cable assembly of the present invention provides an integral strain relief means that includes increased support of the cable within a connector housing as well as the capability to softly "bend" the cable in a desired direction.

It is thought that the cable assembly of the present invention and many of its attendant advantages will be understood form the foregoing description. It will be apparent that various changes may be made in the form, construction and arrangement of the parts thereof without departing from the spirit or scope of the invention or sacrificing all its material advantages. The form herein described is merely a preferred or exemplary embodiment thereof.

We claim:

1. A cable assembly comprising:

a one piece housing including a base having opposed front and rear walls and opposed first and second side walls extending upwardly from said base, said sidewalls extending between said front and rear walls, inner surfaces of said base and walls together defining a cable terminating cavity, at least one of said sidewalls extending at an oblique angle between said front and rear walls, said front wall of said housing further including a cable receiving opening extending therethrough and in communication with said cable terminating cavity, said front wall further including an inwardly directed peninsula shaped protrusion extending a selected distance into said cable receiving cavity, said protrusion being spaced from said obliquely extending sidewall such that said cable receiving opening is positioned between said protrusion and said obliquely extending sidewall, said protrusion and said obliquely extending sidewall defining a cable receiving channel therebetween;

a plurality of terminal members disposed in said housing and having first connecting portions extending into said cable terminating cavity;

an electrical cable having an insulating cover surrounding a plurality of discrete conductors, said cover having an end extending through said cable receiving opening and along said cable channel and about said protrusion to be displaced within said cable terminating cavity, each of said conductors extending from said cover end and terminated to a respective one of said terminal members; and potting materials disposed in and filling remaining portions of said cable terminating cavity, whereby wall of said cable-receiving opening completely surround said cable, and said elongated cable receiving channel provide means for relieving strain on said cable when stress is applied thereto irrespective of said potting material bonding to said insulating cover surface, and further provide means for directing a desired exit path for said cable.

2. The cable assembly of claim 1 wherein said cable receiving channel includes rib members adapted to provide an interference fit with said cable inserted into said housing.

* * * * *

UNITED STATES PATENT AND TRADEMARK OFFICE

CERTIFICATE OF CORRECTION

PATENT NO. : 5,151,050

DATED : September 29, 1992

INVENTOR(S) : James Paul Scholz et al.

It is certified that error appears in the above-identified patent and that said Letters Patent is hereby corrected as shown below:

Claim 1, Column 6, Line 5 - The word "displaced" should be --disposed--.

Claim 1, Column 6, Line 9 - The word "materials" should be --material--.

Signed and Sealed this

Fourteenth Day of September, 1993

Bruce Lehman

*Attest:*

BRUCE LEHMAN

*Attesting Officer*

*Commissioner of Patents and Trademarks*